US005720114A

United States Patent [19]

Guerin

[11] Patent Number: 5,720,114

[45] Date of Patent: Feb. 24, 1998

[54] TOOL FOR POSITIONING OF VINYL CORNER POSTS

[76] Inventor: Scott J. Guerin, 863 Wren Pl., Yorktown Heights, N.Y. 10598

[21] Appl. No.: 520,614

[22] Filed: Aug. 30, 1995

[51] Int. Cl.[6] ..... B43L 7/027

[52] U.S. Cl. ..... 33/451; 33/429; 33/474

[58] Field of Search ..... 33/1 G, 33, 194, 33/197, 404, 405, 407, 411, 429, 451, 474, 478, 485, 526, 533, 613, 645, 646, 647, 648, 42, 492; 269/904

[56] References Cited

U.S. PATENT DOCUMENTS

| | | | |
|---|---|---|---|
| 1,845,801 | 2/1932 | Kupferman | 33/451 |
| 2,437,847 | 3/1948 | Zeise | 33/429 |
| 3,276,128 | 10/1966 | Ponich | 33/407 |
| 4,138,819 | 2/1979 | Sosin | 33/476 |
| 4,658,490 | 4/1987 | Czelusniak et al. | 29/271 |
| 4,736,523 | 4/1988 | Haning | 33/42 |
| 5,119,565 | 6/1992 | Horvath et al. | 33/405 |
| 5,396,710 | 3/1995 | Battaglia | 33/429 |
| 5,524,353 | 6/1996 | Fink | 33/451 |
| 5,535,523 | 7/1996 | Endris | 33/474 |

FOREIGN PATENT DOCUMENTS

| | | | |
|---|---|---|---|
| 249157 | 6/1947 | Switzerland | 33/474 |

*Primary Examiner*—G. Bradley Bennett
*Attorney, Agent, or Firm*—Oppedahl & Larson

[57] ABSTRACT

A tool for aligning vinyl corner posts during installation has a flat, generally L-shaped body member. The body member is formed from first and second leg portions which meet in a 90° angle. An aperture is formed in the interior edge of the body member which is symmetrically disposed with respect to the 90° angle for receiving a vinyl corner post. To use the tool, the vinyl corner post is pushed into the aperture where it fits snugly. The assembly is then pressed against the corner of the building, and the flat interior edges of the legs of the body member are pressed against the sides of the house to align the corner post to the building. The corner post is then nailed into position, while sliding the tool on the corner post to maintain the proper orientation along the entire length of the post.

17 Claims, 5 Drawing Sheets

TOOL FOR POSITIONING OF VINYL CORNER POSTS

This application relates to a tool for the positioning of vinyl corner posts or moldings during the application of siding to the exterior of a building.

BACKGROUND OF THE INVENTION

Vinyl siding is generally applied to the exterior of a building as horizontal strips. At the corners of the building, a corner post or molding is used to hold the ends of these strips in place, and to conceal the ends to provide a finished look. These corner posts may be 8 feet or more in length, to extend from along the entire extent of the siding, and are generally quite flexible. This makes it challenging to hold the corner post in the correct vertically aligned position that is necessary to achieve a professional-looking installation.

U.S. Pat. No. 4,658,490 discloses an installation tool which is intended to overcome this difficulty and to facilitate the installation of vinyl corner posts. The tool is an 8-foot long section of angle iron with brackets along the edges thereof which are used to affix the vinyl corner post to the tool prior to placing the corner post in position on a building. The corner post is then nailed into place, after which the brackets must be released to remove the tool.

The tool described in U.S. Pat. No. 4,658,490 has received little, if any, commercial acceptance among installers of vinyl siding, who generally continue to use no specialized tools at all to assist in the positioning and installation of vinyl corner posts. Nonetheless, there exists a real need for the tool which assist in this process without creating additional work. It is the object of the present invention to fulfill this need.

SUMMARY OF THE INVENTION

This and other objects of the invention are achieved using a tool which has a flat, generally L-shaped body member. The body member is formed from first and second leg portions having straight interior edges which are positioned at a 90° angle to each other. An aperture for receiving a vinyl corner post is formed in the interior corner of the body member. The aperture is symmetrically disposed with respect to a line bisecting the 90° angle.

To use the tool, the vinyl corner post is pushed into the aperture where it fits snugly. The assembly is then pressed against the corner of the building, and the flat interior edges of the legs of the body member are pressed against the sides of the house to align the corner post to the building. The corner post is then nailed into position. The tool may be held or tacked in a single position, or slid along the corner post to maintain the proper orientation along the entire length of the post during installation.

DETAILED DESCRIPTION OF THE INVENTION

Figure 1:
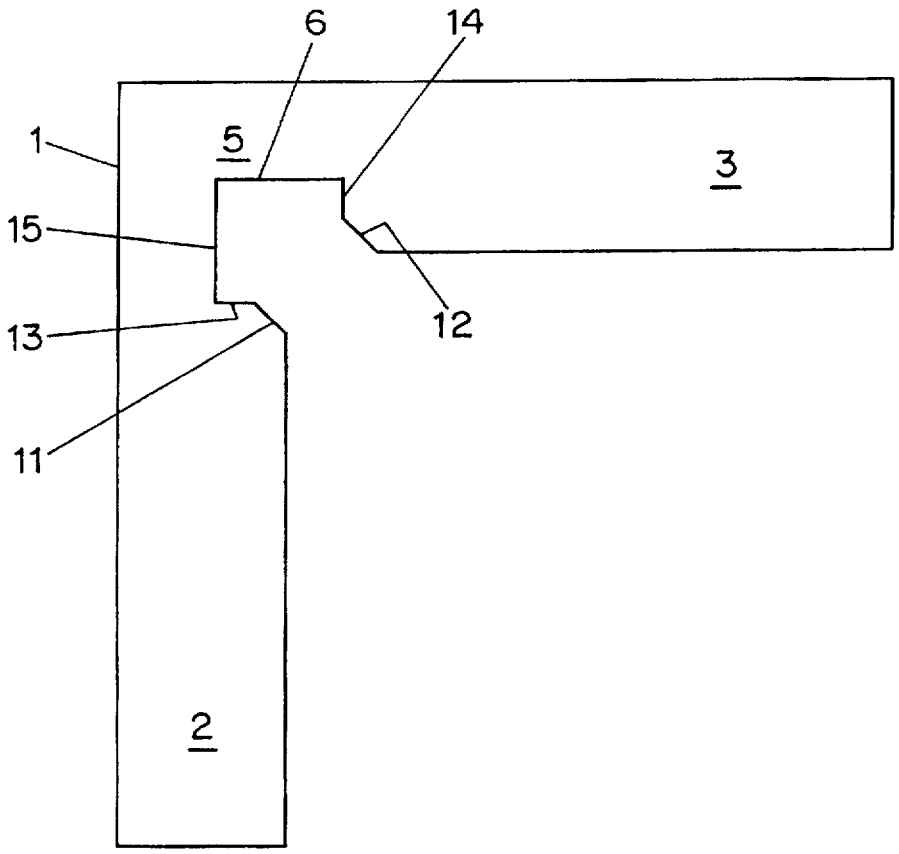
FIG. 1 shows a first embodiment of a tool in accordance with the present invention.

FIG. 1 shows a first embodiment of the tool in accordance with the present invention. The tool has a flat body member 1 which is formed from first and second leg portions 2 and 3. The first and second leg portions meet in a 90° angle. An aperture 4 is formed in the interior corner and is symmetrically disposed with respect to the 90° angle for receiving a vinyl corner post.

The aperture 4 is adapted to receive a vinyl corner post snugly, and to force the corner post into a square orientation. This can be accomplished, for example, by an aperture of the shape shown in FIG. 1, where the aperture has a first pair of edges 11,12 extending at a 45° angle from the inner edges of the first and second legs 2, 3, respectively, to inward ends of the first edges, a second pair of edges 13, 14 extending from the inward ends of the first edges 11, 12 to inward ends of the second edges at a 90° angle with respect to the inner edge of the first and second legs 2, 3, respectively, and a third pair of edges 15, 16 extending from the inward ends of the second edges 13, 14 to a common point on a line extending between the vertex of the 90° angle on the inner edge and the vertex of the 90° angle on the outer edge, said third pair of edges 15, 16 being parallel to the inner edges of the first and second legs 2, 3, respectively.

The tool of the present invention may be made of any flat, substantially rigid stock including wood; metal, particularly aluminum, and or plastic, particularly acrylonitrile/butadiene/styrene (ABS) rubbers, such as CYCLOLAC, and polycarbonates such as LEXAN. The body member 1 is formed as a thin flat sheet, for example having a thickness of from ⅛ inch to ⅜ inch, preferably 3/16 inch. The width of the legs should be sufficient to accommodate the aperture and provide a dimensionally stable margin 6 between the aperture and the outer edges of the legs. This will depend to some extent on the size of the corner post for which the tool is sized. For example, for a nominal 4 inch corner post (actual size 3 ¼ inches) the legs are suitably 2 to 3 inches, and preferably 2 ½ inches wide. The length of the legs requires a compromise between the convenience of using a smaller tool and the ability of a longer leg to provide a truer alignment. In general, legs of from about 10–20 inches, and most preferably around 12–14 inches are preferred.

The size of the aperture will depend on the size of the corner post with which the tool is intended to be used. In the case of the embodiment shown in FIG. 1 for a nominal 4" corner post, the first edges are suitably 1 ¼ inches in length, the second edges are suitably ¼ inch and the third edges are suitably 3 ¼ inches.

Figure 2:
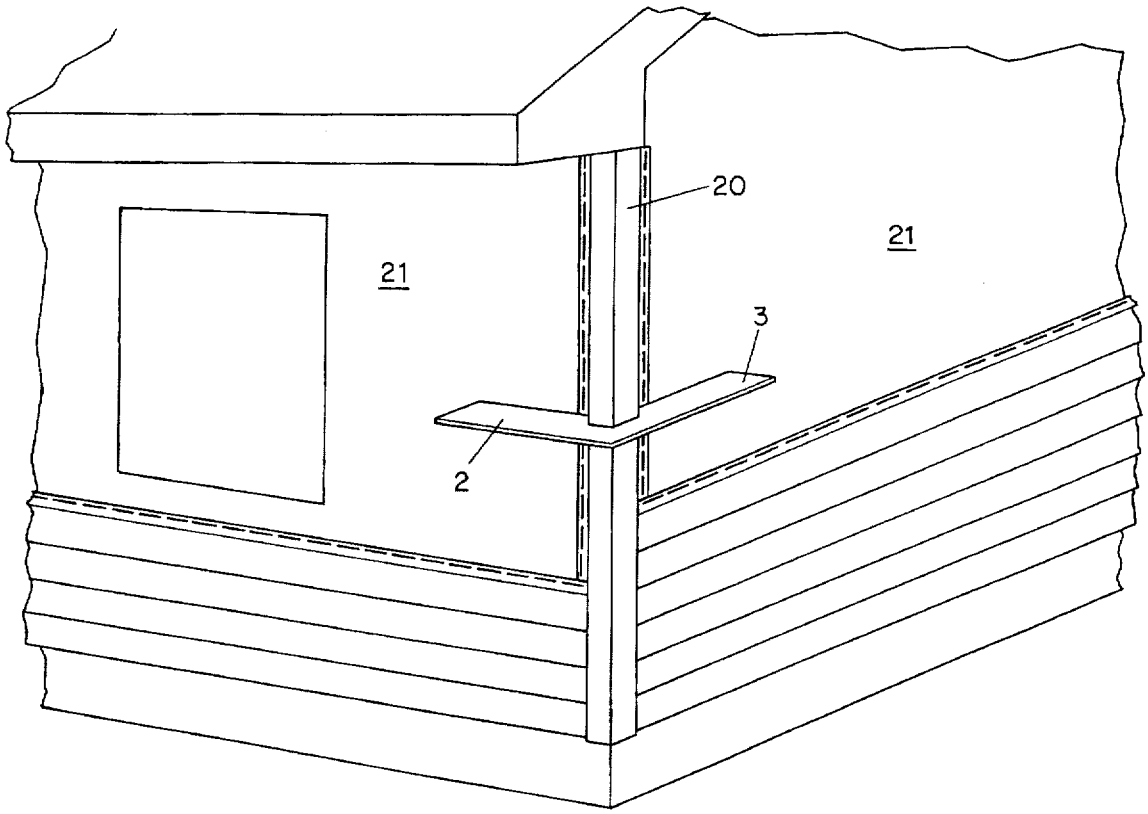
FIG. 2 shows the use of a tool in accordance with the present invention.

FIG. 2 illustrates the manner in which the tool of the present invention is used. As shown, the aperture of the tool 1 is snapped over a corner post 20. The legs 2 and 3 of the tool 1 are then pressed tightly against the sides 21 of the building to orient the corner post squarely. The post is then nailed into position while pressure on the tool is maintained. If desired, the tool can be slid along the length of the corner post as nailing proceeds to maximize alignment along the entire length of the corner post. When installation of the corner post is complete, the tool is simply snapped off of the corner post.

Figure 3:
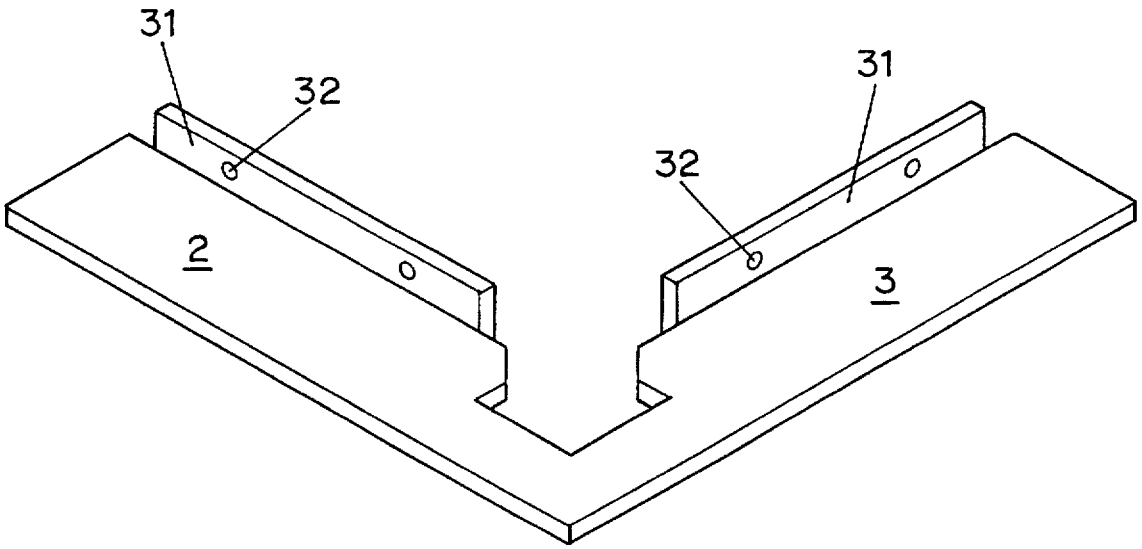
FIG. 3 shows a second embodiment of a tool in accordance with the present invention.

While the embodiment of the present invention shown in FIG. 1 provides a very useful and effective tool for the simple alignment of corner posts, there are numerous enhancements which can be added to the tool. For example, as shown in FIG. 3, it may be advantageous to incorporate a fence 31 on the inner edge of the legs 2 and 3 to increase the amount of surface area in contact with the side of the building. The fence, which extends upwards (or upwards and downwards) improves the alignment which can be achieved using the tool. The fence 31 may include holes 32 through which the tool can be tacked in place in the side of the building. In this case, the tool may be left in a single centrally-located position while the post is being nailed in place.

Figure 4:
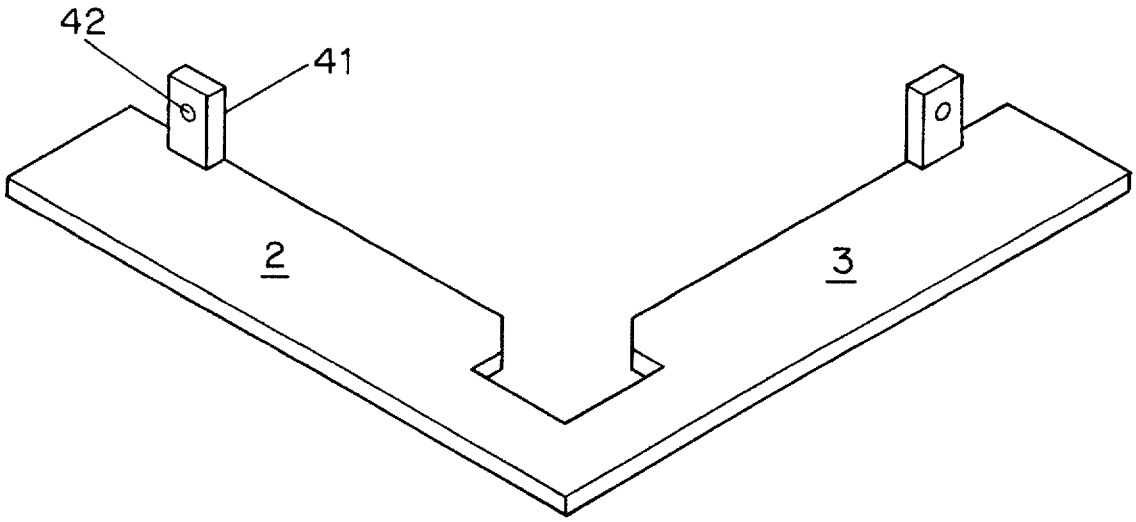
FIG. 4 shows a third embodiment of a tool in accordance with the present invention.

An alternative to the use of the fence with holes in it is shown in FIG. 4. In this case, flanges 41 having holes 42 formed therein extend upwards (or upwards and downwards) from the inner edges of the legs provide additional surface area and attachment points.

Figure 5:
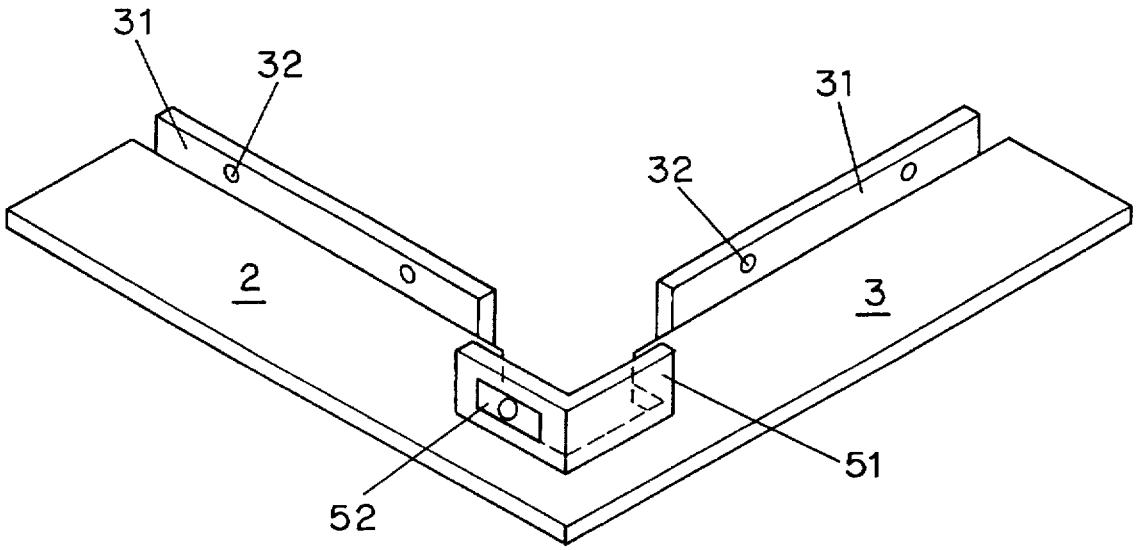
FIG. 5 shows a fourth embodiment of a tool in accordance with the invention.

FIG. 5 shows a further embodiment of the invention. In this case, the edge of the aperture 4 has a raised lip 51. This lip increases the contact area between the tool and the vinyl corner post, and may serve to improve the stability of the positioning and alignment process. The lip 51 can be present alone, or it can be combined with a raised fence portion 31 as shown in FIG. 5.

The raised lip 51 or the fence 31 can be used to support a spirit level 52 which assists in obtaining a square alignment with the building. A level may also be affixed via a holder formed on the surface or outer edge of the body member.

Figure 6A:
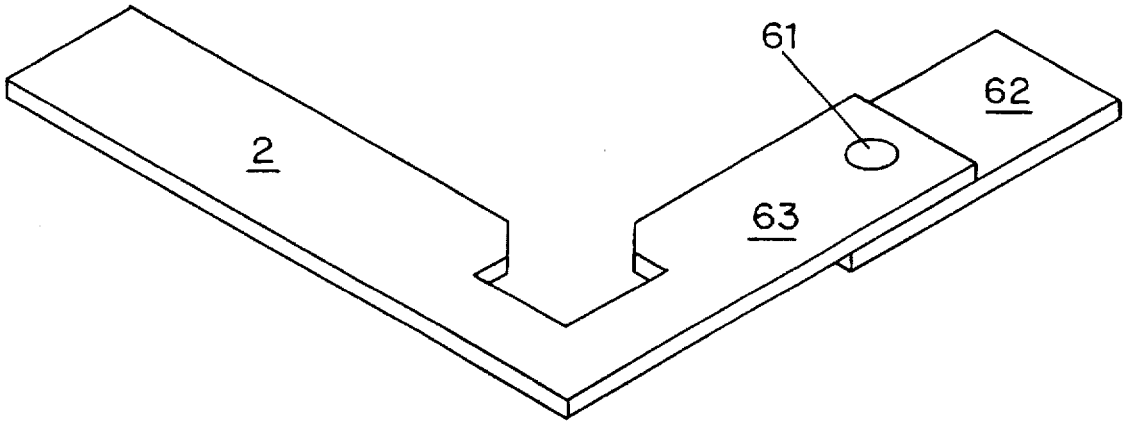
FIGS. 6*a* and 6*b* shows a fifth embodiment of a tool in accordance with the invention.
Figure 6B:
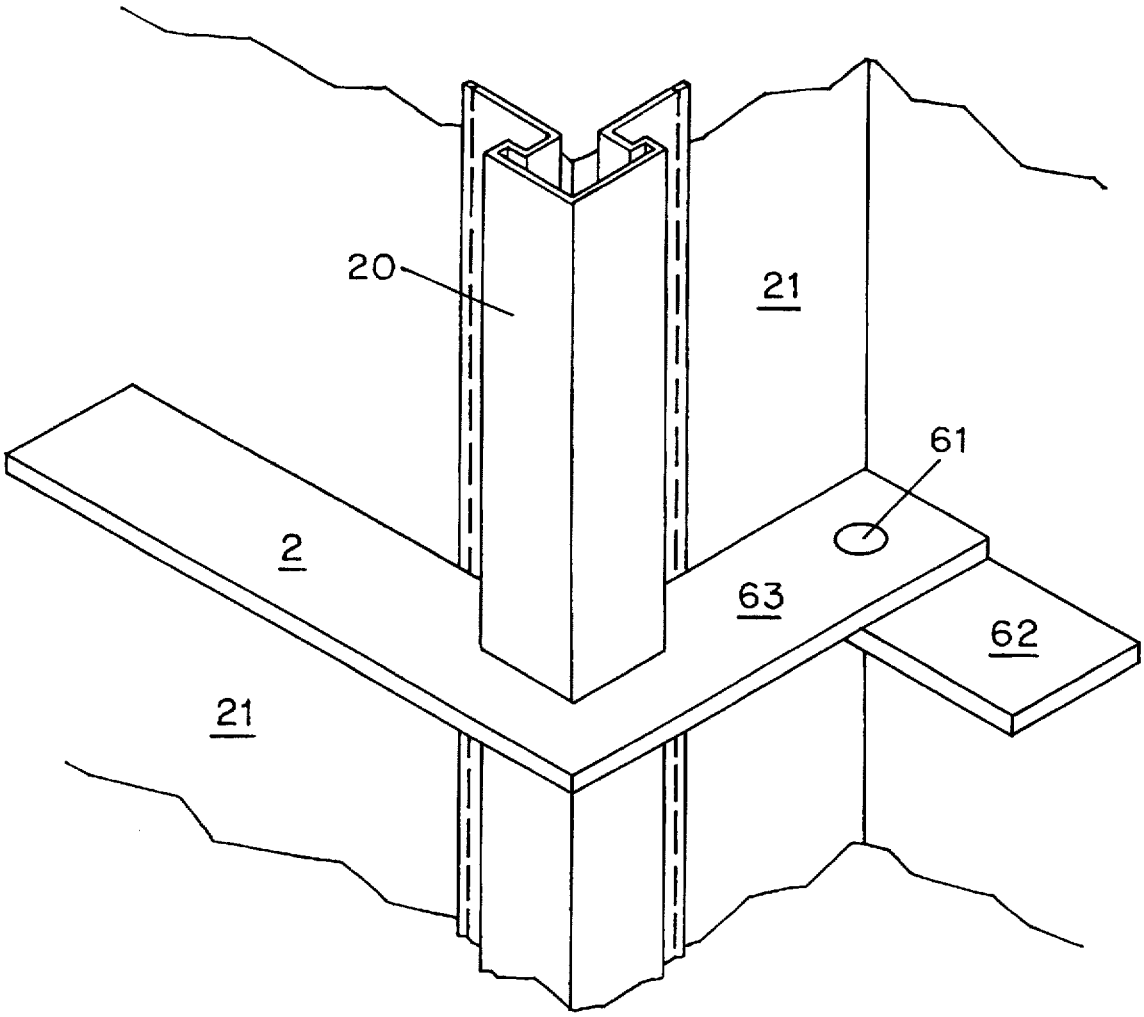

FIG. 6*a* shows a further embodiment of the invention. While most corners on buildings will generally be at least 12 inches from the nearest wall such that a tool of the size described above will fit around the corner, there may be some instances where the legs of the tool would be longer than the wall. For these applications, it may be desirable to have a hinged tool of the time shown in FIG. 6*a* which permits one or both of the legs to be shortened to accommodate a short wall region as shown in FIG. 6*b*. Thus, a hinge 61 is incorporated into a shortened leg 63 for pivotal attachment of a leg extension 62.

Figure 7:
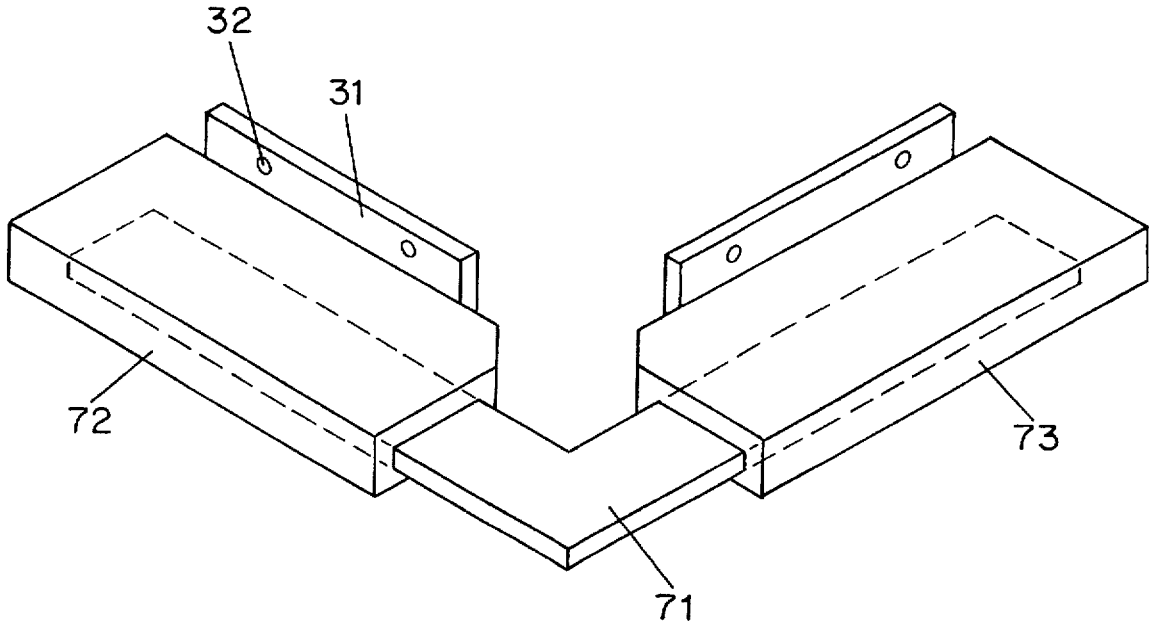
FIG. 7 shows a sixth embodiment of a tool in accordance with the invention.

FIG. 7 shows yet a further embodiment of the invention which permits a single tool to be used with corner posts of several different sizes. As shown, the body member of the tool is formed as three parts: an l-shaped base portion 71, and two slidable portions 72 and 73 which slide along the two legs of the base portion to define the size of the aperture. Stops may be provided to lock the slidable portions 72 and 73 at predetermined positions along the base portion corresponding to standard sizes of corner posts.

While the foregoing embodiments provide many variations of the invention it should be understood that these embodiments are merely exemplary and are not intended to limit the invention. Thus, various combinations of the features shown in the various figures may be utilized without departing from the spirit and scope of the invention.

I claim:

1. A tool for installation of vinyl siding comprising a flat, L-shaped body member, said body member being formed from first and second leg portions connected together, said first and second leg portions having straight interior edges disposed at a 90° angle to one another, and said flat body member having an aperture formed in the interior edge of the first and second leg portions for snugly receiving a vinyl corner post, said aperture being symmetrically disposed with respect to a line bisecting the 90° angle formed by the first and second legs.

2. A tool according to claim 1, wherein the aperture is bounded by a first pair of edges extending at a 45° angle from the interior edges of the first and second legs, respectively, to inward ends of the first edges, second pair of edges extending from the inward ends of the first edges to inward ends of the second edges at a 90° angle with respect to the inner edge of the first and second legs respectively, and third pair of edges extending from the inward ends of the second edges to a common point on the line bisecting the 90° angle, said third edges being parallel to the interior edges of the first and second legs, respectively.

3. A tool according to claim 1, further comprising a fence affixed to the interior edge of each of the legs and extending perpendicularly from the body member.

4. A tool according to claim 3, wherein the fence has holes formed therein for tacking of the tool to the side of a building during installation of vinyl siding.

5. A tool according to claim 3, further comprising a level affixed to the fence.

6. A tool according to claim 3, wherein the aperture is bounded by a first pair of edges extending at a 45° angle from the inner edges of the first and second legs, respectively, to inward ends of the first edges, second pair of edges extending from the inward ends of the first edges to inward ends of the second edges at a 90° angle with respect to the inner edge of the first and second legs respectively, and third pair of edges extending from the inward ends of the second edges to a common point on a line extending between the vertex of the 90° angle on the inner edge and the vertex of the 90° angle on the outer edge, said third edges being parallel to the inner edges of the first and second legs, respectively.

7. A tool according to claim 1, further comprising a raised lip extending perpendicularly from the body member along the edge of the aperture.

8. A tool according to claim 7, further comprising a level affixed to the raised lip.

9. A tool according to claim 7, further comprising a fence affixed to the interior edge of each of the legs and extending perpendicularly from the body member.

10. A tool according to claim 9, wherein the fence has holes formed therein for tacking of the tool to the side of a building during installation of vinyl siding.

11. A tool according to claim 9, wherein the aperture is bounded by a first pair of edges extending at a 45° angle from the inner edges of the first and second legs, respectively, to inward ends of the first edges, second pair of edges extending from the inward ends of the first edges to inward ends of the second edges at a 90° angle with respect to the inner edge of the first and second legs respectively, and third pair of edges extending from the inward ends of the second edges to a common point on a line extending between the vertex of the 90° angle on the inner edge and the vertex of the 90° angle on the outer edge, said third edges being parallel to the inner edges of the first and second legs, respectively.

12. A tool according to claim 9, further comprising a level affixed to the raised lip.

13. A tool according to claim 9, further comprising a level affixed to the fence.

14. A tool according to claim 1, wherein at least one of the leg portions is divided into two parts; further comprising at least one hinge connecting the two parts of the two-part leg portion and permitting the two parts two articulate between a first position in which the interior edges of the two parts of the two-part leg portion are aligned, and a second position in which the interior edges of the two parts of the two-part leg portion are at an angle of 90° or greater.

15. A tool according to claim 1, further comprising a plurality of flanges affixed to the interior edges of the first and second legs and extending perpendicularly to the body member.

16. A tool according to claim 15, wherein the flanges have holes therein for tacking of the tool to a building during installation of a vinyl corner post.

17. A tool according to claim 1, wherein said leg portions comprise an inner portion and an outer portion slidably mounted on said inner portion to permit adjustment of the size of the aperture.

* * * * *